US006557774B1

(12) United States Patent
Krueger

(10) Patent No.: US 6,557,774 B1
(45) Date of Patent: May 6, 2003

(54) NON-PRESSURIZED SPACE HEATING SYSTEM AND APPARATUS

(76) Inventor: Gregory A. Krueger, 815 Plum St., Eau Claire, WI (US) 54703

( * ) Notice: Subject to any disclaimer, the term of this patent is extended or adjusted under 35 U.S.C. 154(b) by 0 days.

(21) Appl. No.: 09/416,601

(22) Filed: Oct. 12, 1999

(51) Int. Cl.[7] ..... F24D 3/10
(52) U.S. Cl. ..... 237/66; 237/70
(58) Field of Search ..... 237/66, 7, 70, 237/59, 60

(56) References Cited

U.S. PATENT DOCUMENTS

| | | | | | |
|---|---|---|---|---|---|
| 707,361 | A | * | 8/1902 | Searle | 237/66 |
| 892,515 | A | * | 7/1908 | Gold | 237/66 |
| 1,418,583 | A | * | 6/1922 | Lincke | 237/66 |
| 2,166,235 | A | * | 7/1939 | Cornell, Jr. | 237/66 |
| 3,554,441 | A | * | 1/1971 | Malmstrom | 237/56 |
| 3,834,355 | A | * | 9/1974 | Arant | 237/66 |
| 4,296,883 | A | * | 10/1981 | Yanna | 237/59 |
| 4,345,715 | A | * | 8/1982 | Van Craenenbroeck | 237/66 |
| 4,471,907 | A | * | 9/1984 | Gerstmann | 237/65 |
| 4,718,922 | A | * | 1/1988 | Roffelsen | 55/55 |
| 4,848,655 | A | | 7/1989 | Woodin et al. | 237/8 R |
| 4,921,166 | A | * | 5/1990 | Matsumoto et al. | 237/60 |
| 4,925,093 | A | | 5/1990 | Moore, Jr. et al. | 237/19 |
| 4,946,098 | A | | 8/1990 | Prevot | 237/19 |
| 5,007,583 | A | * | 4/1991 | Schwarz | 237/66 |
| 5,039,007 | A | | 8/1991 | Wolter | 236/12.1 |
| 5,076,494 | A | * | 12/1991 | Ripka | 237/19 |
| 5,361,751 | A | | 11/1994 | Biggs | 126/101 |
| 5,372,185 | A | | 12/1994 | Lannes | 165/70 |
| 5,390,660 | A | * | 2/1995 | Danielson | 126/271.2 R |
| 5,456,409 | A | * | 10/1995 | Roffelsen | 237/66 |
| 5,485,879 | A | | 1/1996 | Lannes | 165/70 |
| 5,573,183 | A | | 11/1996 | Leskinen | 237/8 R |
| 5,707,007 | A | | 1/1998 | Fiedrich | 237/8 R |
| 5,718,374 | A | * | 2/1998 | Cnossen | 237/8 R |

FOREIGN PATENT DOCUMENTS

| | | | | | |
|---|---|---|---|---|---|
| EP | 543285 | A | * | 5/1993 | 237/66 |
| FR | 2647951 | A | | 8/1991 | |
| JP | 38146 | A | * | 4/1978 | 237/66 |
| JP | 405157256 | A | * | 6/1993 | 237/66 |
| JP | 406117647 | A | * | 4/1994 | 237/66 |
| NL | 8702-649 | A | | 6/1989 | |
| WO | WO 90/02300 | | | 3/1990 | |

* cited by examiner

*Primary Examiner*—Derek Boles
(74) *Attorney, Agent, or Firm*—Anthony J. Bourget

(57) ABSTRACT

A non-pressurized hydronic space heating system for circulating heated fluid through coils placed within a dwelling or structure. The system includes a heat tank for heating liquid, and piping connected to the heat tank for receiving the heated liquid and circulating the liquid throughout coils and back to the heat tank. The heat tank is positioned above the coils. The system includes a releasing means for releasing air contained within the piping. The releasing means or auxiliary fluid isolation ballast allows for the release of air within the piping so that continued circulation of the liquid throughout the system may occur and so that the fluid within the system is isolated from the atmosphere to seal the system from introduction of air bubbles.

36 Claims, 6 Drawing Sheets

NON-PRESSURIZED SPACE HEATING SYSTEM AND APPARATUS

FIELD OF THE INVENTION

This invention relates to a novel hot water space heating system and apparatus.

BACKGROUND-DESCRIPTION OF PRIOR ART

Space heating systems of the hydronic variety have become more and more popular due to the quality of the radiant heat, uniformity of heat distribution, and other reasons. Common radiant heating systems include circulating heated water through coils which are placed within floors, ceilings or along baseboards. The coils are often assembled in the form of panels which may be laid within concrete and/or wooden floors and ceilings. Typically the systems use a heating vessel or boiler coupled with a pressurized supply of water. The pressurized system requires use of several components for pressure reducing, air venting, water expansion and tempering and other items necessary to deal with the pressurized source. Water pressure reducing valves are commonly used to change the supply water pressure to system operating pressures. City supply water pressure is approximately 70 p.s.i., and typical well water pump pressure is approximately 45 p.s.i. Normal system operating pressure is approximately 12 to 15 p.s.i., thus requiring pressure reducing components.

In order to circulate the water, air pockets or bubbles must be bled from the radiant coils or panels, otherwise the circulator would lock up with an air gap and would not be able to route the heated water throughout the dwelling or location which is to be heated. Such systems are pressurized and sealed so that air pockets and bubbles are eliminated; Installation and sealing of such a system is problematic, and use of components under pressure can result in extra stress on the components resulting in shortened product life.

Were the pressurized system to lose its seal or to have not been properly bled, the installation would require repeated sealing. Common maintenance to the system may also require resealing.

Pressurized water sources are not always available. In remote areas which do not have pressurized water, the radiant heat method is largely unavailable. Further, a pressurized system presents additional danger where the water is heated under pressure and passed through various components which are designed to handle and temper the pressurized water. While such components for handling pressurization are designed to handle specified loads, the need for such components would not be present if there was no pressurization. Accordingly, the cost of the entire system can be lessened if concerns over pressurization are eliminated.

In the past, another common variety of radiant type heating system was an open system which used a heating vessel or boiler, and also required a constant or manual source of water supply. Such systems required constant air removal methods and oxidation reduction treatment. Bleeding of the radiators was typically required in such systems. Hydronic systems historically used only gravity to move the heating water (i.e., hot water rises to radiators while the water returns as it cools). Such system required very high temperature to create this effect (180 to 200 degrees Fahrenheit) and required very large piping and radiators to transfer the heat. Such system required a large tank to handle water expansion, and required frequent filling and monitoring of the water level due to evaporation. Further, such system required a configuration where the heating vessel was positioned at a point beneath the heating radiators, while the expansion tank was to be positioned at the highest point above the heating radiators. Such open type system also used a vent that usually exited the top of the building for release of air and vapors. The system vent was capable of freezing in cold climates. The vent had to be higher than the highest radiator of the system to allow air to escape and usually was configured through an attic to the outside environment. Special treatments were also required to be added to such system to retard corrosion of piping caused by the oxygen in the system due to the frequent addition of supply water.

Applicant has been unable to locate a non-pressured, self-contained hydronic system. Providing such a system can eliminate the overall cost of the system and reduce efforts in installation while also eliminating the concerns of pressure, treatment, and sealing. Providing efficient radiant heat to locations which do not have a pressurized water source is a further goal. Moreover, the historic non-pressurized systems have become obsolete since they are too bulky, require continued monitoring, and operate at very high temperatures. Applicant has invented a practical non-pressurized space heating system which utilizes a conventional type of water heater.

While applicant has found several attempts to utilize water heaters for a variety of combination purposes (see for example U.S. Pat. Nos. 4,848,655; 4,925,093; 4,946,098; 5,039,007; 5,076,595; 5,361,751; 5,372,185; 5,485,879; 5,573,183; 5,707,007; Foreign Patent No. 8702-649-A; Foreign Patent No. WO 90/02300; and Foreign Patent No. 2,657,951), applicant is unaware of any non-pressurized radiant heating system of the type described herein.

OBJECTS AND OBJECTIVES

It is an object of this invention to provide a radiant heating system which does not require a pressurized water source.

It is another object of this invention to provide a radiant heating system that utilizes standard glass-line, direct-fired, gas water heaters.

It is still another object of this invention to provide a radiant heating system which is self-contained that does not need a replenishing water supply.

It is a further object of this invention to provide a radiant heating system characterized by both low manufacturing cost, maintenance cost, versatility, and portability.

It is a further object of the invention to provide energy savings in the form of utilizing previously heated water already contained within the tank.

Other objects and advantages of the present invention will become apparent to those skilled in the art from the drawings, the detailed description of the preferred embodiments and the claims.

SUMMARY OF THE INVENTION

The non-pressurized heating system comprises a standard heating vessel or water heater for heating the water to be circulated throughout the radiant coils. The coils connecting to the piping of the heating system are laid throughout the flooring, along baseboards or ceiling area for space heating. The radiant heating coils reconnect with the piping so the water which had circulated and has now become cooler returns to the heater to be heated for reuse and recirculation. The water heater is positioned above the coils. The system includes a means for releasing air contained within the piping. In a specific embodiment the system includes an isolation or auxiliary ballast or container which holds liquid and operates to impart an atmospheric pressure and seals the self-contained system. Air pockets or bubbles throughout the radiant coils eventually work their way through the system to the releasing means for release to the atmosphere. Such venting prevents air lock in the system, which otherwise might typically cause a circulating pump to fail. A conventional water heater can be configured to accommodate the system. The usual relief port of a conventional water heater is utilized as the radiant coil supply line. The cold water inlet of the typical water heater receives the return from the radiant coils. The typical hot water port of the water heater is connected with the isolation ballast.

The liquid heater apparatus of the present invention includes a heating tank to contain a liquid, a gas burner positioned to heat the liquid, a supply port from which heated liquid may be supplied to circulating coils which are laid throughout the space to be heated, a return port to which liquid is returned from the coils, and a releasing means for releasing air contained within the liquid heater. In a specific embodiment the apparatus includes an isolation ballast located above the water heater. The isolation ballast provides atmospheric isolation between the atmosphere and the water contained in the system. The isolation ballast also operates to allow venting of air from the connected coil system. The apparatus includes a modified conventional water heater described above, and connects with coil systems to circulate fluid and provide radiant heat. The apparatus is incorporated into radiant heat systems; and multiple apparatus and systems may be used together. A separate apparatus and/or system may be used to provide radiant heat to separate levels in a dwelling or structure. Multiple systems can be combined as needed, to supply heat to larger single-level flooring areas, or numerous levels. A further embodiment includes use of an apparatus similar to that described above yet including a coil unit. With use of a combined coil unit, the apparatus is versatile for use in numerous locations.

DETAILED DESCRIPTION OF THE PREFERRED EMBODIMENTS

Figure 1:
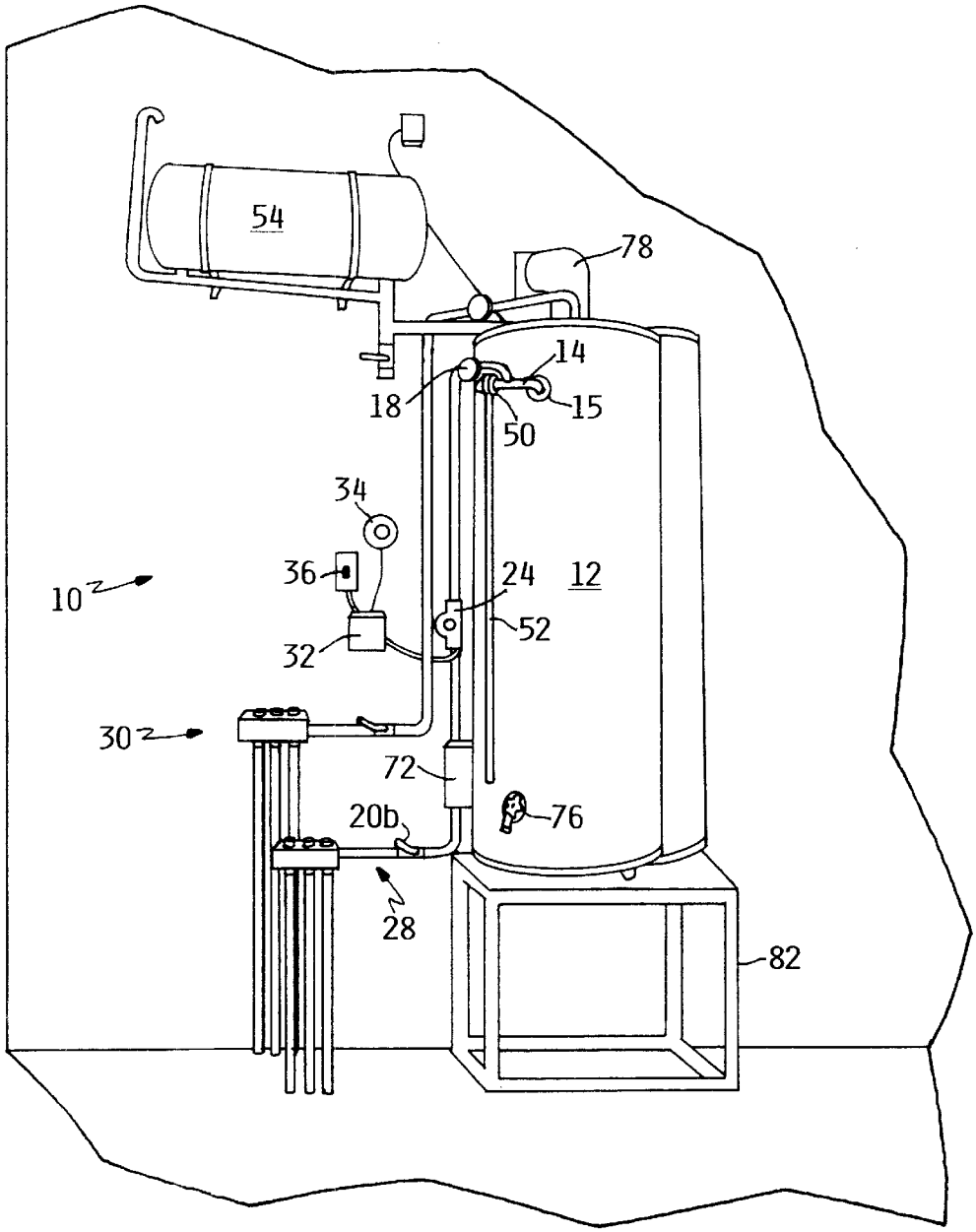
FIG. 1 is a perspective view of the system of the present invention.
Figure 2:
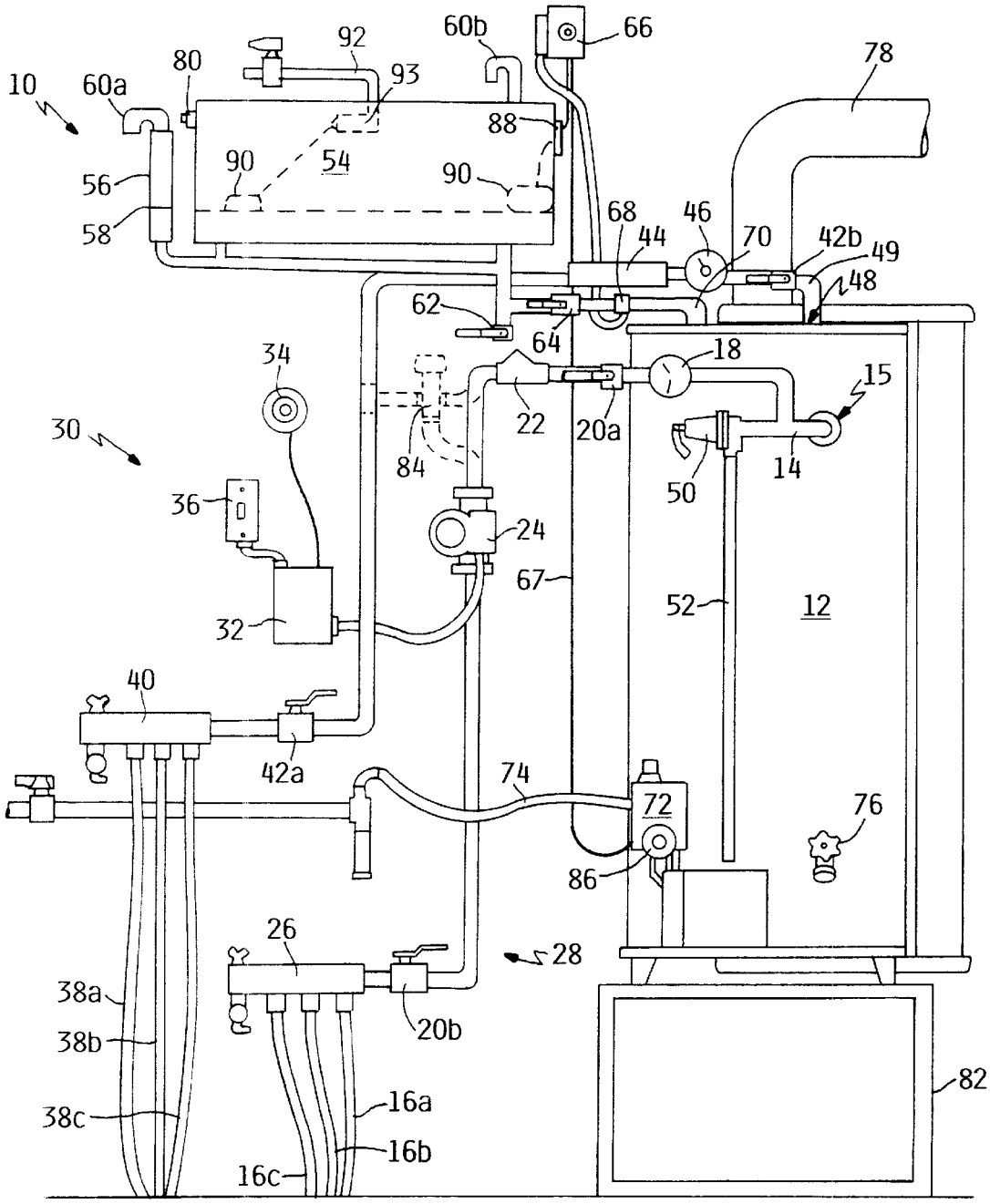
FIG. 2 is a front view of the present invention and further showing use of an optional tempering valve and an optional automatic refill.

Referring to FIGS. 1 and 2, the reference number 10 designates one embodiment of the space heating system 10. The heating system 10 has a heat tank 12 for heating water and/or other liquid for use throughout the system. Heat tank 12 is typically and preferably a glass-lined water storage tank having a heat source preferably a direct-fired gas burner of the type traditionally used in standard water heaters. Heat tank 12 is preferably a fifty gallon natural gas fired direct vent heater supplied with an installed thermostatically controlled gas valve which allows for adjustment of the desired supply water temperature. Heat tank 12 could be of any variety available, including direct vent, gravity vent, or power vented, natural gas fired, L.P. (propane gas), fuel oil or electrically heated with capacity varying between approximately forty and eighty gallons depending upon the application.

Heat tank 12 is placed on stand 82 in order to meet with safety specifications of state codes.

Heat tank 12 has a hot water outlet 14 so hot water may be drawn from the heat tank 12 and ultimately transmitted through supply pipes 16*a–c*. Pipes 16*a–c* are distributed throughout a floor and/or ceiling panel (see, for example, coils 94, FIG. 6) so the heated water may be distributed throughout the desired region and radiate the heat therefrom. Water travels from heat tank 12 through supply piping 28 toward supply pipes 16*a–c*. Supply piping 28 is preferably ¾ inch inner diameter copper tubing. Supply piping 28 includes hot water outlet 14 which projects from supply port 15 and continues to supply shut-off valve 20*b* and supply piping manifold 26. Hot water or liquid passes through supply port 15 to hot water outlet 14 to supply temperature indicator 18, then through supply shut-off valve 20*a* and swing check valve 22. Supply shut-off valve 20*a* can be operated manually. Swing check valve 22 prevents water from routing back toward heat tank 12. Circulating pump 24 circulates the water throughout supply piping 28, supply pipes 16*a–c*, (and throughout coils 94; see FIG. 6) and return piping 30. Water circulated from circulating pump 24 continues through supply shut-off valve 20*b* and through supply piping manifold 26 where it is distributed through supply pipes 16*a–c*.

Thermostat 34 regulates the temperature of the heating environment by controlling control relay 32 which is connected to and activates circulating pump 24 as shown in FIG. 2. Control relay 32 could be replaced with a line voltage thermostat. A 120 volt electric supply is provided via control relay 32. System switch 36 activates control relay 32 so the system may be turned on or off as desired. Circulating pump 24 distributes the fluid throughout system 10 and coils 94.

Water having circulated throughout the radiant heat panels (See FIG. 6 for coils 94 which comprise panels; the water being fed via supply pipes 16*a–c*) returns through return pipes 38*a–c* which are mounted at return piping manifold 40. Return piping 30 is preferably ¾ inch inner diameter copper tubing. Water flowing through the system returns through return shut-off valve 42*a* and includes a high temperature limit switch 44. Switch 44 is generally wrapped or clamped around piping to detect surface temperatures. Such detectors are commonly requested for boilers under state codes. Return temperature indicator 46 is also provided along with return shut off valve 42*b* before having the returned water pass through return port 48 in route to heat tank 12 for reheating. Return port 48 located on top of heat tank 12 preferably leads internally to a tube (not shown) within heat tank 12 which directs the cooled return water toward the bottom level of the heat tank 12 so that the cooler water is mixed with the warmer water before traveling to the supply piping 28. High temperature limit switch 44 operates as a safety mechanism to shut off the gas in the event of a malfunction of circulating pump 24, gas control 72, or other component.

Relief valve 50 is provided at hot water outlet 14. Relief valve 50 is commonly a 30 PSI valve so that excess water pressure may be disbursed as needed. Relief pipe 52 connects with relief valve 50 for release of excess water and pressure. Since the system 10 is not pressurized, however, relieve valve 50 is not necessary. It is included for the purpose of compliance with states codes relating to boilers. Other components used for dealing with pressurization are also not required for operation of the system other than to satisfy codes.

A water heater in a standard radiant system environment does not utilize supply piping as attached to the outlet port 15. A typical water heater utilizes return port 48 for receiving a pressurized cold water source, typically utilizes ballast supply 70 as a hot supply source, and typically utilizes outlet port 15 for a pressure relief valve. In the present system, however, return port 48 is adapted to receive return pipe 49 (and return piping 30), outlet port 15 is utilized for the supply piping 28 and ballast supply 70 is utilized for connection with ballast 54.

Ballast 54 includes level indicator 56 which reflects the water or liquid level 58 that is present within ballast 54. Ballast 54 is connected to heat tank 12 through ballast supply 70. Water is contained in ballast 54 and throughout ballast shut-off valve 64 and low water indicator fitting 68. Low water indicator fitting 68 is connected to low water switch 66 by low water switch wiring 67. If a low water condition exists at indicator fitting 68, low water indicator fitting 68 causes low water switch 66 to regulate or turn off gas valve 72. During operation of the system water does not actively circulate throughout ballast 54, shut-off valve 64, or low water indicator, yet such water is held in reserve to replenish any water volume loss that might occur in the system 10. While Applicant has experienced little, if any water volume loss, such loss, if any, occurs upon the escape of air bubbles within the system as such air bubbles migrate toward ballast 54.

If a low water condition is experienced, low water switch 66 operates (thermostatic) gas control 72 thereby turning off heat tank 12. Gas control 72 regulates gas supply line 74 which controls the supply of gas to the burner unit (not shown) within heat tank 12. Heat tank 12 further includes water drain 76 for draining water (or filling) from heat tank 12 as desired. Exhaust 78 is also connected with heat tank 12 in order to release exhaust and other vapors from the gas burning function and operation of the system.

Ballast 54 includes plug 80 which is used for filling ballast 54 with water or other liquid for maintaining water level of the system. Ballast 54 further contains ballast vent 60*b* to allow further venting of the system and release of gasses or air to the atmosphere.

As circulating pump 24 activates, heated water is extracted from outlet port 15 and distributed through supply pipes 16*a–c* and throughout coils 94 to heat the desired environment. Water circulated through coils 94 returns through return pipes 38*a–c* and circulates back into heat tank 12 through return port 48. The temperature of the water returning through return port 48 is lower than the temperature of water passing through outlet port 15 because the circulating water was used throughout the coils 94 to heat the desired areas.

The volume of water at any time located within the coils remains generally constant, as does the volume within the system. There may be situations where air bubbles are present in the water or located at components throughout the system. Eventually these air bubbles and/or pockets circulate throughout the system and into heat tank 12. Once located in heat tank 12, the air bubbles escape the system through ballast supply 70 and are released to the atmosphere through vent 60*a* and/or 60*b*. A release of a volume of air is replaced by an identical volume of water from ballast 54.

The presence of air bubbles in a system can cause problems particularly relating to air locking. Specifically, as air bubbles migrate to circulating pump 24, water or liquid is not able to be circulated in certain situations. A problem that may occur is that the circulating pump will lock up or otherwise not be able to perform a water circulating function. In addition to a risk being that the circulating pump 24 might burn out, heated water would not be able to pass through to heat the desired space. Accordingly, the invention includes releasing means for releasing air contained within the system. The releasing means includes ballast 54 as described herein, and may well include a tank, receptacle, reservoir, or other means capable of holding liquid and practical for such application. As air is released through releasing means, such air bubbles are removed from the system 10 which accordingly assists in the continued circulation of the liquid throughout the system 10. The releasing means also may include means for imparting an atmospheric pressure on the liquid, including a ballast, tank, receptacle, reservoir, or other structure capable of holding water, configured to be connected to heat tank 12. The releasing means further includes means for sealing the system from introduction of outside air, and such means for sealing may include liquid or other material contained within the releasing means to prevent flow of air into the heat tank 12 which would be combined with or mixed into liquid which is circulated throughout coils 94. The above described releasing means which uses a liquid automatically allows for air contained within the system to be released.

While ballast 54 contains fluid, the remainder of fluid in system 10 is isolated from the atmosphere, thereby preventing air bubbles or other matter from being introduced to the system.

While there is no pressurization of the system from an external source, such as by connection to pressurized city water, well water pump, or other direct pressure source, ballast 54 imparts an atmospheric pressure to the system through ballast supply 70. The amount of pressure is directly proportional to the atmospheric pressure of water contained in ballast 54. The atmospheric pressure is sufficient to seal system 10 so water may circulate throughout heat tank 12 and coils 94 and to provide replacement liquid in the event air bubbles escape. While the system is non-pressurized, applicant recognizes that the liquid contained therein receives an atmospheric pressure imported through ballast 54. As such, the system may alternatively be considered atmospherically pressurized.

Since water in ballast 54 does not circulate like the water in coils 94, the water in ballast 54 remains at room temperature which minimizes evaporation. As the system is atmospherically isolated by use of ballast 54, there is no loss of water which is circulated throughout coils 94. When water is heated and/or expanded, it is subsequently cooled and contracted throughout its travel through coils 94.

Water utilized throughout the system may be water that is commonly used in other radiant heating systems, or it may also consist of antifreeze or a combination of liquid or liquids for use in such systems.

The hydronic heating system 10 may be optionally equipped with tempering valve 84 as shown in FIG. 2. Tempering valve 84 connects supply piping 28 to return piping 30. Tempering valve 84 is useful particularly in situations where outside temperatures reach sub-zero. Operation of the system can also be enhanced by use of tempering valve 84 to smooth out or eliminate fluctuations in the supply and return water temperatures caused by drastic changes in outdoor temperature. Tank temperature control knob 86 is typically adjusted to set gas control 72 at 100–120 degrees Fahrenheit which controls the supply temperature of water being circulated through outlet port 15.

In situations of fluctuations in outdoor temperature, or during sub zero conditions, tank temperature control knob 86 may be set at an increased temperature (i.e., 130 degrees Fahrenheit). Use of tempering valve 84 as configured allows higher temperatured water to be released from outlet port 15 for mixing with lower temperature water returning from return pipes 38. Therefore, the return water temperature is increased and is more effective for recirculation throughout the system. Accordingly, the system is capable of supplying higher temperature water to accommodate for sever temperature conditions.

Because the system does not require pressurized water, it can be installed in remote geographical areas. The system works especially well in cabins, hunting shacks, seasonal buildings or garages, and in locations where utility hook-ups are lacking. An LP (propane) fuel tank and portable electric generator can fuel the system and regulate system operation.

Referring to FIG. 2, ballast 54 includes optional float sensor 88, use of which would eliminate low water switch 66. Float sensor 88 includes float 90 which raises and lowers according to water level 58. In situations where water level 58 is less than a predetermined level, float sensor 88 activates, thereby providing a warning signal and/or operating to turn off gas valve 72.

Float sensor 90 may optionally be configured to operate supply water float actuated fill valve 93. Optional float 90 connects to fill valve 93, and triggers water from source 92 when a low water condition is experienced. Water source 92 is a pressurized source of water to supply ballast 54 upon signal from float sensor that water level 58 is low. Ballast refill 92 deactivates when water level 58 is proper. Accordingly, while ballast refill 92 may provide water from a pressurized source, system 10 itself is not under such constant pressure. With such configuration, a user of system 10 can take advantage of the efficiency and ease of installation of a non-pressurized system, yet provide security in operation with use of a single point of non-continuous refill pressure. Refill 92 is useful as back up in situations where water is used as the liquid for circulating through the coils 94, or where evaporation of fluid in ballast 54 occurs. Any such evaporation occurring in ballast 54 is minimized where a water/antifreeze combination is used as the fluid. Antifreeze commonly used for traditional pressurized hydronic units may be used, or a mixture of such antifreeze and water may be ideal depending upon cost factors. A mix of 50 percent antifreeze and 50 percent water is preferred.

The invention may include ballast refill means which includes ballast refill 92 and may also include any other source for supplying water or liquid, including any large basin, reservoir, or other source. Ballast refill means may also be a pressurized source of supply. Such means may be activated automatically upon command from float 90 and valve 93. Automatic Ballast refill means includes ballast refill 92, float 90 and float valve 93. Other common water level sensing and refill devices may also be employed. Low water fitting 68 and low water switch 66 may be eliminated with use of float sensor 88 and float 90. Instead, float sensor 88 may be connected to gas valve millivolt pilot (by wires not shown) from sensor 88 to gas control 72.

Ballast refill means is an optional feature for use as a precaution if water or liquid leaks or evaporates. Despite the use of such optional ballast refill means, the system is self contained in that it is not regularly supplied with any water or liquid. The system is atmospherically isolated in that it utilizes means for sealing which eliminates introduction of air. Liquid present within ballast acts to seal from the atmosphere the liquid present in the remainder of the system. Use of ballast 54 above tank 12 operates to seal system 10. Fluid contained in ballast 54 prevents air from entering tank 12 which seals system 10.

Figure 3:
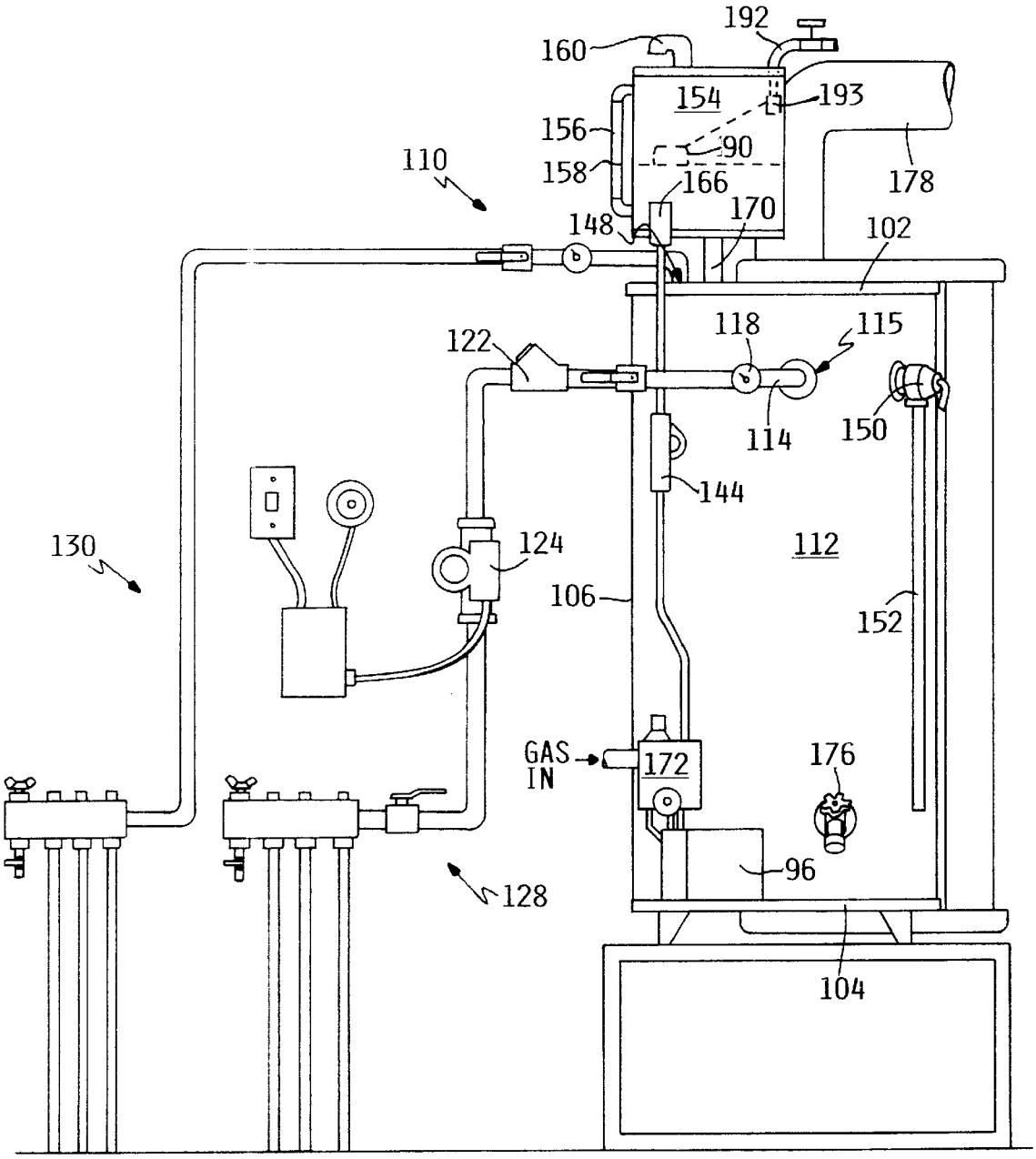
FIG. 3 is a front view of a further embodiment of the apparatus of the present invention.

FIG. 3 illustrates a further embodiment of the apparatus aspect of the present invention. Heating apparatus 110 includes heat tank 112, gas burner 96 and a means for releasing air contained within the heat tank 112. A ballast 154 functions to release the air contained within heat tank 112, and it is recognized that any type of receptacle for containing a volume of fluid may perform such function. Such receptacle of course would be capable of practical use with the apparatus, thus excluding enormous receptacles. Heat tank 112 is configured to contain liquid. The heat tank 112 is generally equipped with a top portion 102, a bottom 104, a wall 106, and a flue 178. A gas burner 96 operates to heat liquid inserted into heat tank 112 for circulation from a supply port 115 defined by heat tank 112. Water traveling from the supply port circulates through heating coils which have been placed throughout the space to be heated, and returns to a return port 148 defined by heat tank 112. Air that becomes trapped within the heat tank 112 may escape through a releasing means such as ballast 154. Heating apparatus 110 may be connected to supply piping 128 and return piping 130 in order to operate in a hydronic heating system. Use of ballast 154 allows for releasing air from the heating apparatus 110 to assist in continuing circulating of the liquid throughout a space heating system to which the apparatus 110 is connected. Absent ballast or means for releasing air, the circulating pump 124 would retain air which would lessen the effectiveness of circulation. Ballast 154 includes water level indicator 156 to indicate water level 158. A low water switch 166 may also be configured as shown in FIG. 3 to deactivate the heating apparatus 110 upon a condition where low water is experienced in ballast 154. Ballast 154 includes ballast vent 160 to allow a ballast to communicate with the atmosphere and act as a relief for air which migrates from heat tank 112. Liquid contained within ballast 154 imparts atmospheric pressure on the liquid within heat tank 112 in direct proportion to the volume of liquid contained in ballast 154. The releasing means is located above the heat tank 112 which is positioned for imparting the atmospheric pressure. Ballast 154 may also include an optional ballast refill or other means for refilling the ballast. Typical automatic refilling mechanisms may be employed, such as combined use of float 190, optional supply source 192, and supply switch 193, or a manual refill can be configured.

Figure 5:
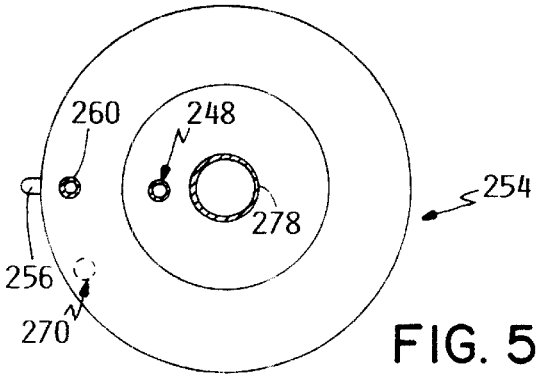
FIG. 5 is a top view of the apparatus of FIG. 4.
Figure 4:
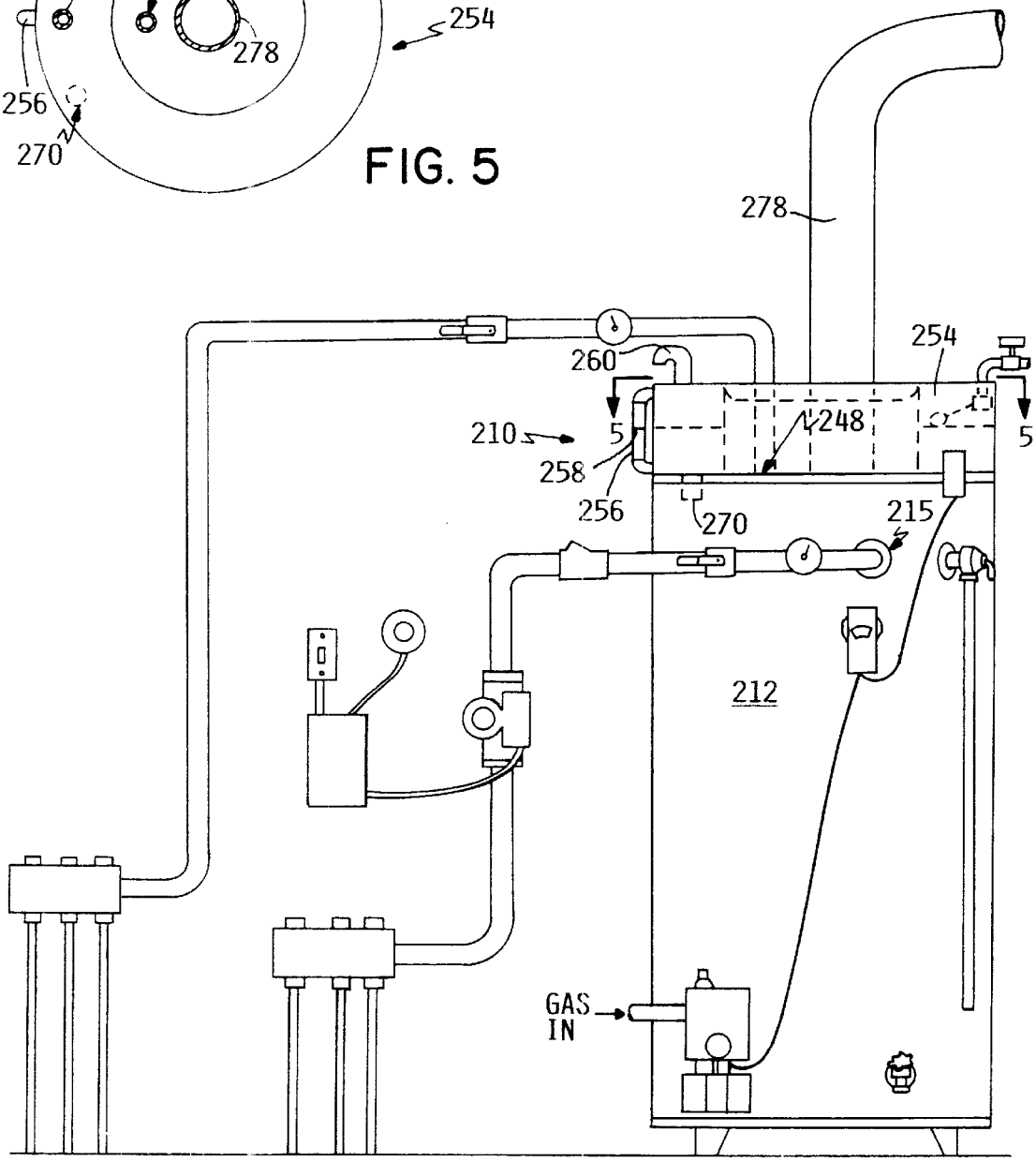
FIG. 4 is a front view of yet a further embodiment of the present invention.

Referring to FIGS. 4 and 5, the embodiment of an apparatus aspect of the invention is also presented. In this embodiment heat tank 212 is configured with ballast 254 which sits atop heat tank 112. Ballast 254 is substantially doughnut-shaped and provides an efficient configuration and position atop the heat tank 212. Ballast 254 may be integrally connected to heat tank 212. As shown in FIGS. 4 and 5, water from coils external to heat tank 212 returns to the heating apparatus 212 via return port 248 which is defined in heat tank 212. Heating apparatus 210 further includes ballast supply 270 which allows for communication between ballast 254 and heat tank 212. Heat tank 212 may also be configured for attachment with ballast 254 so that such components can be alternatively attached and detached. Ballast 254 further contains ballast vent 260 for a release of air from heating tank 212. Flue 278 projects through the center portion defined by ballast 254 for the release of vapors. In systems utilizing a sealed combustion heater, the flue 278 may also operate for intake of outside air for operating heat tank 112. Ballast 254 is equipped with water level indicator 256 so that an operator may visibly monitor the level of the water 258.

Heating apparatus 210 may be connected to the coils of a hydronic space heating system and allows for release of air contained within heat tank 212 and throughout the system so that proper fluid circulation is experienced and as also stated in previous embodiments. Heat tank 212 further includes supply port 215 from which water is circulated to the heating coils of the space to be heated.

Figure 6:
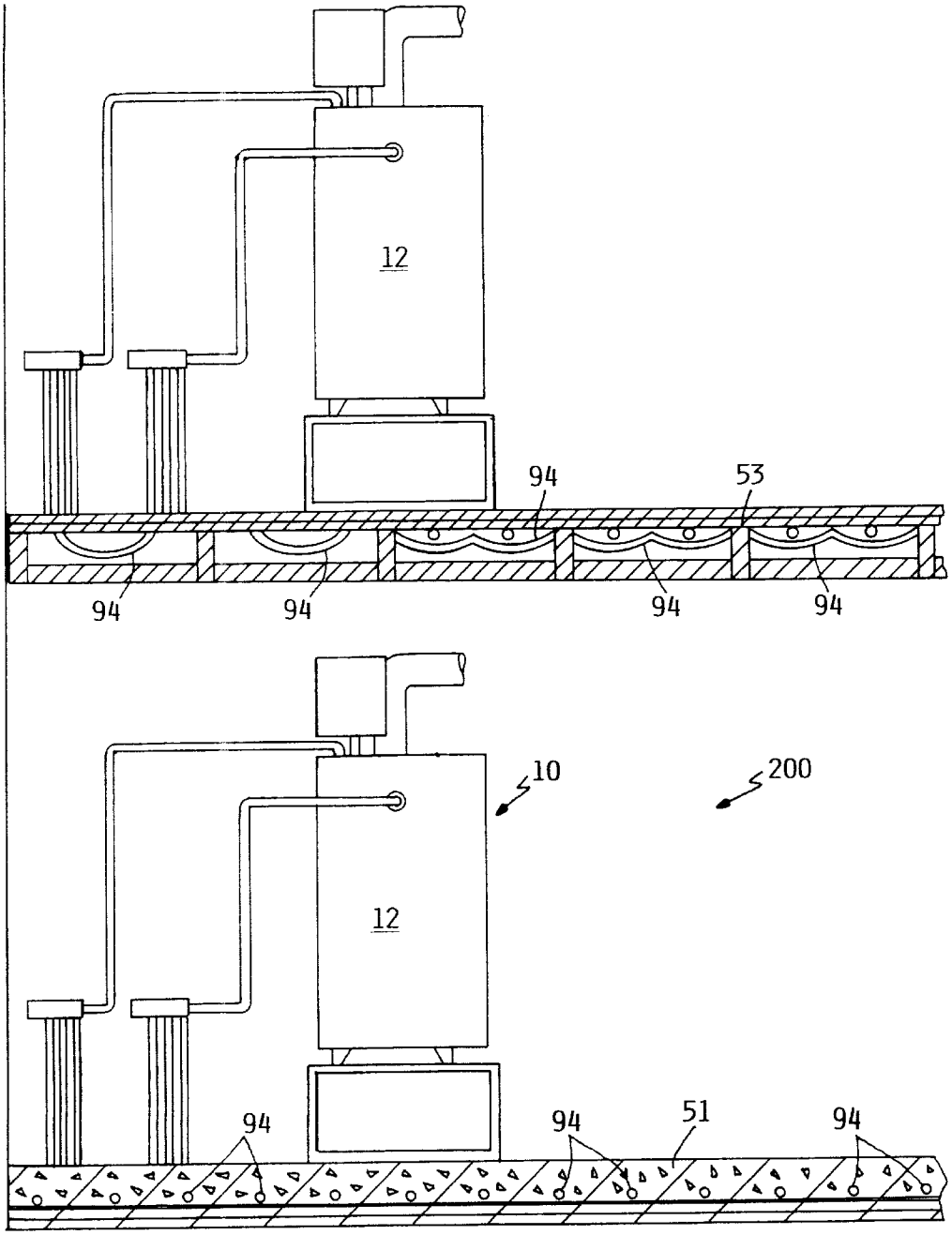
FIG. 6 is side elevational view of a further embodiment of the present invention.

FIG. 6 shows a further embodiment of the present invention. The invention includes a multiple floor structure, and as FIG. 6 depicts, may include concrete floor 51 and wooden floor 53. Such flooring is not limited to the particular material involved, however, concrete flooring is typically used as a base for hydronic heating systems. Multiple concrete flooring structures can be employed, and it is appreciated that heating coil units can be placed within ceilings as well. Each floor is equipped with a non-pressurized space heating system 10 substantially as described in previous embodiments. Use of a multi-level system 200 allows for heating of space in various levels for comfort throughout an entire dwelling or structure. Multiple space heating systems 10 can be included on each individual floor. Because of the absence of need for pressurization, multiple water pressure hook-ups are not required, and sealing and pressurizing of a system is also not warranted. Each space heating system 10 can be contained in a small area such as a closet or other space, and each separate space heating system 110 can be separately monitored with its own thermostat control.

Figure 7:
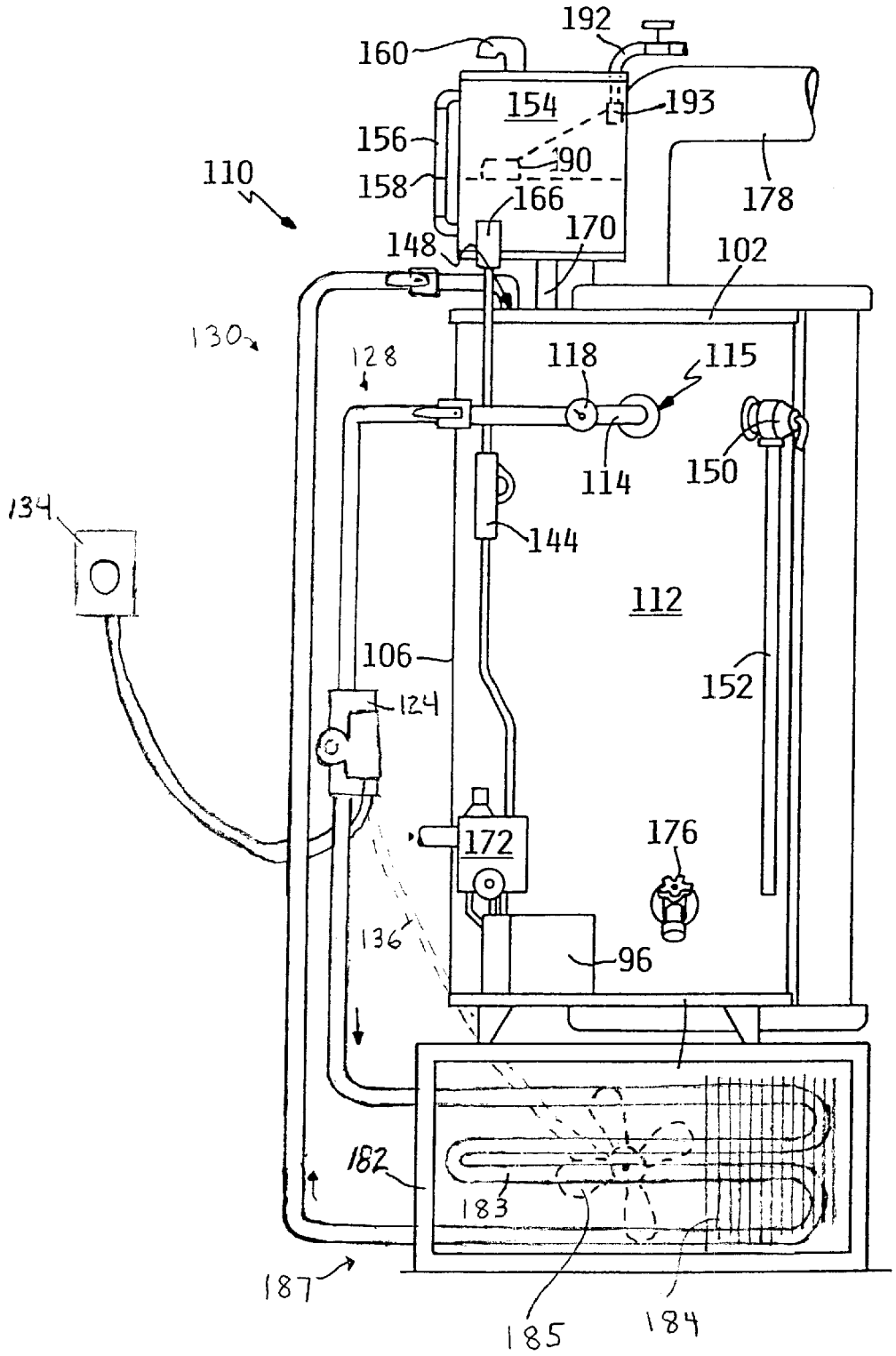
FIG. 7 is a front view of a further embodiment of the apparatus of the present invention.

Referring to FIG. 7, a further embodiment of an apparatus aspect of the invention is presented. In this embodiment heating apparatus 110 includes supply piping 128 and return piping 130 which connects with coil unit 187. Supply piping 128 includes circulator 124 for circulating heated water as shown. Coil unit 187 includes coils 183 which are preferably wrapped or bundled to maximize the surface area beneath heat tank 112. Coils 183 radiate heat from the heated water as the water passes through the coils 183. Thermostat 134 activates the apparatus 110 by initiating circulator 124 and fan 185. Fan 185 is connected to circulator 124 by fan wire 136. The coils 183 may be placed behind a screen or fins 184 so that the heat may radiate from the apparatus 110 to the environment to be heated. Fins 184 also provide protection from direct contact with hot water filled coils 183. Coil unit 187 may also include fan 185 for blowing heat radiated from coils 183. Coil unit 187 also includes stand 182 upon which heat tank 112 may be placed and within which the coils 183 and fan 185 are positioned. In such configuration, the heating apparatus 110 may be positioned in a dwelling that is not, cannot, or will not be equipped with standard radiant coils embedded within the flooring or ceilings. The entire apparatus may be moved from location to location, and optionally equipped with wheels. The apparatus would preferably occupy an area comparable to that occupied by a refrigerator or other large appliance. The apparatus can also be reduced in size for heating smaller areas or for ease of portability.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

I claim:

1. A non-externally pressurized space heating system, said system comprising:

a standard direct-fired gas burner type automatic storage water heater for heating liquid;

piping connected to said water heater for receiving the heated liquid and circulating the heated liquid throughout coils and back to said water heater, said piping including a circulator for circulating liquid through said piping and said coils, said water heater positioned above said coils; and non-circulating releasing means for releasing air contained within said system, said non-circulating releasing means coupled with said water heater at a top portion of said water heater;

wherein the release of air assists in continuing circulation of the liquid throughout said system and throughout said coils in order to provide space heating.

2. A heating system according to claim 1 wherein said piping and said releasing means are adapted to provide said space heating system with liquid circulation while avoiding external pressurization.

3. A heating system according to claim 1 wherein said releasing means provides an atmospheric pressure on the liquid.

4. A heating system according to claim 1 wherein said releasing means includes a liquid for isolating liquid contained in said system from the atmosphere.

5. A heating system according to claim 1 wherein said releasing means includes a ballast.

6. A heating system according to claim 5 wherein said ballast includes ballast refill means for refilling said ballast.

7. A heating system according to claim 5 wherein said ballast holds a liquid and provides the liquid to said water heater through a ballast supply.

8. A heating system according to claim 5 wherein said ballast includes a vent.

9. A heating system according to claim 1 wherein said circulator is an electric pump.

10. A heating system according to claim 1 wherein said piping includes coils.

11. A heating system according to claim 1 wherein said piping includes a tempering valve.

12. A heating system according to claim 1 wherein said releasing means is located above said water heater.

13. A heating system according to claim 1 wherein said non-circulating releasing means is positioned above said coils for releasing air contained within said coils.

14. A heating system according to claim 1 wherein said system includes liquid to be heated and circulated throughout said system and said coils.

15. A liquid heater for use in a non-externally pressurized space heating system, said liquid heater comprising:

a standard automatic storage water heater to contain a liquid, said water heater having a top portion, a bottom, a wall, and a flue, said flue defining a passageway for release of gasses;

a direct-fired gas burner positioned to heat the liquid within said water heater;

a supply port from which heated liquid may be supplied to circulating coils;

a return port to which liquid is returned from the circulating coils to said water heater; and non-circulating releasing means for releasing air contained within said liquid heater, said non-circulating releasing means coupled with said water heater at a top portion of said water heater, substantially all of said releasing means spaced away from said passageway;

wherein said gas burner heats the liquid for circulation from said supply port through the circulating coils back to said return port; and wherein said releasing means allows air to be released from said liquid heater to assist in continuing circulation of the liquid throughout the non-pressurized space heating system.

16. A liquid heater according to claim 15 wherein said releasing means is spaced away from said flue.

17. A liquid heater according to claim 15 wherein said releasing means includes a liquid for isolating liquid contained in said water heater from the atmosphere.

18. A liquid heater according to claim 15 wherein said releasing means is located above said water heater.

19. A liquid heater according to claim 15 wherein said releasing means includes a ballast.

20. A liquid heater according to claim 19 wherein said ballast includes ballast refill means for refilling said ballast.

21. A liquid heater according to claim 19 wherein said ballast includes a vent.

22. A liquid heater according to claim 19 wherein said ballast includes a low water switch.

23. A liquid heater according to claim 19 wherein said ballast is integrally connected to said water heater.

24. A liquid heater according to claim 19 wherein said ballast is doughnut shaped.

25. An atmospherically pressurized space heating system, said system comprising:

a standard direct-fired gas burner type automatic storage water heater for heating liquid;

piping connected to said water heater for receiving the heated liquid and circulating the heated liquid throughout coils and back to said water heater, said piping including a circulator for circulating liquid through said piping and said coils, said water heater positioned above said coils; and non-circulating automatic releasing means for automatic releasing air contained within said system, said releasing means adapted for providing said system with an atmospheric pressure, said non-circulating releasing means coupled with said water heater at a top portion of said water heater;

wherein the release of air from said system assists in continuing circulation of the liquid throughout said system and said coils in order to provide space heating.

26. A heating system according to claim 25 wherein said releasing means includes a ballast.

27. A heating system according to claim 26 wherein said releasing means includes means for sealing said system from introduction of air.

28. A heating system according to claim 25 wherein said system includes a circulator for circulating liquid through said piping and coils.

29. A multi-level non-externally pressurized space heating system, said multi-level system comprising:

at least two non-externally pressurized space heating systems, each of said non-externally pressurized space heating systems comprising:

a standard direct-fired gas burner type automatic storage water heater for heating liquid;

piping connected to said water heater for receiving the heated liquid and circulating the heated liquid throughout coils and back to said water heater, said piping including a circulator for circulating liquid through said piping and said coils, said water heater positioned above said coils; and non-circulating releasing means for releasing air contained within said piping, said non-circulating releasing means coupled with said water heater at a top portion of said water heater;

each of said space heating systems placed on a different level;

wherein the release of air contained within each of said space heating systems assists in continuing circulation of the liquid throughout each of said systems and throughout said coils in order to provide space heating to a multi-level environment.

30. A multi-level non-pressurized space heating system according to claim 29 wherein said releasing means is adapted to provide an atmospheric pressure on the liquid contained in each of said at least two space heating systems.

31. A non-externally pressurized space heating apparatus, said apparatus comprising:

a standard direct-fired gas burner type automatic storage water heater to contain a liquid, said water heater having a top portion, a bottom, a wall, and a flue;

a gas burner positioned to heat the liquid within said water heater;

a coil unit from which heat radiates;

supply piping through which heated liquid may be supplied to said coil unit;

return piping to which liquid is returned from said coil unit to said water heater; and non-circulating releasing means for releasing air contained within said apparatus, said non-circulating releasing means coupled with said water heater at a top portion of said water heater;

wherein said gas burner heats the liquid for circulation through said supply piping to said coil unit and back through said return piping; and wherein said releasing means allows air to be released from said water heater to assist in continuing circulation of the liquid throughout the non-pressurized space heating apparatus.

32. A non-pressurized space heating apparatus according to claim 31 wherein said coil unit includes a fan for blowing heat from coils of said coil unit.

33. A non-externally pressurized space heating apparatus according to claim 31 wherein said coil unit is located below said water heater.

34. A non-pressurized space heating apparatus according to claim 31 wherein said coil unit includes a frame for supporting said apparatus.

35. A method for space heating, said method comprising the steps of:

providing a non-externally pressurized space heating system, said system comprising:

a standard direct-fired gas burner type automatic storage water heater for heating liquid;

piping connected to said water heater for receiving the heated liquid and circulating the heated liquid throughout coils and back to said water heater, said piping including a circulator for circulating liquid through said piping and said coils, said water heater positioned above said coils; and non-circulating releasing means for releasing air contained within said system, said non-circulating releasing means coupled with said water heater at a top portion of said water heater;

filling said system with liquid;

heating the liquid with said water heater;

activating said circulator in said piping to circulate the liquid throughout said system; and automatically releasing air from said system through said releasing means;

whereby the release of air assist in continuing circulation of the liquid throughout said system to provide space heating.

36. A method for space heating according to claim 35 wherein said non-circulating releasing means releases air contained within said coils of said system.

* * * * *

UNITED STATES PATENT AND TRADEMARK OFFICE

CERTIFICATE OF CORRECTION

PATENT NO. : 6,557,774 B1
DATED : May 6, 2003
INVENTOR(S) : Gregory A. Kruger

It is certified that error appears in the above-identified patent and that said Letters Patent is hereby corrected as shown below:

Title page,
Item [56], References Cited, the following US PATENT DOCUMENTS should be included:

| | | | |
|---|---|---|---|
| -- 4,601,426 | 7/1986 | Brosenius | 237/59 |
| 4,915,296 | 4/1990 | Matsumoto et al. | 237/8 R -- |

Signed and Sealed this

Thirtieth Day of September, 2003

JAMES E. ROGAN
*Director of the United States Patent and Trademark Office*